United States Patent [19]

Chaudhry et al.

[11] 4,363,486

[45] Dec. 14, 1982

[54] ELECTRONIC GAMING APPARATUS

[76] Inventors: Jagdish C. Chaudhry; Lorena Chaudhry, both of 1198 Fremont Ave., Los Altos, Calif. 94022

[21] Appl. No.: 202,115

[22] Filed: Oct. 30, 1980

[51] Int. Cl.[3] ..... A63F 5/04

[52] U.S. Cl. ..... 273/143 B; 273/138 A; 40/471

[58] Field of Search ..... 273/138 A, 139, 143 B, 273/143 R, 143 C; 40/467, 465, 463, 466, 470, 471, 518, 520, 521

[56] References Cited

U.S. PATENT DOCUMENTS

| | | | |
|---|---|---|---|
| 3,759,525 | 9/1973 | Davis | 273/143 R |
| 3,874,669 | 4/1975 | Ariano et al. | 273/85 G |
| 3,940,136 | 2/1976 | Runte | 273/DIG. 28 |
| 4,110,925 | 9/1978 | Strand et al. | 40/466 |

*Primary Examiner*—Vance Y. Hum
*Assistant Examiner*—Leo P. Picard
*Attorney, Agent, or Firm*—Claude A. S. Hamrick

[57] ABSTRACT

Briefly, a preferred embodiment of the present invention includes an electronic gaming apparatus including an outer housing having a front panel hingedly attached to form a housing closure. The outer surface of the front panel provides a playing surface including windows which various indicators may be viewed and switches enabling player interaction. The rear side of the front panel is in the form of a printed circuit board including a network of printed circuit conductors disposed thereon. Also affixed to the rear side of the first panel and supported thereby are various switches, electronic components, indicators, lights and facsimile display modules, all of which are electrically interconnected by means of the printed circuit conductors. The facsimile display modules each include a pair of web carrying reels which are reversibly driven by a single reversible motor and a coil spring for maintaining constant tension in the web as it is wound and unwound upon the respective reels. Photodetectors are also provided for accurately detecting and facilitating the positioning of web carried indicia relative to a viewing window.

7 Claims, 3 Drawing Figures

ELECTRONIC GAMING APPARATUS

BACKGROUND OF THE INVENTION

1. Field of the Invention

The present invention relates generally to electronic gaming apparatus and more particularly to an electronically controlled gaming mechanism that randomly displays facsimiles of a plurality of playing cards or other gaming symbols which when displayed in particular combinations, signify a player win.

2. Discussion of the Prior Art

Electronically controlled gaming apparatus such as the type used to display a plurality of playing cards in game formats including blackjack, poker, etc., have long been known in the prior art. Such games typically utilize sophisticated electronic display devices or complicated electro-mechanical devices in order to randomly display images of the various playing cards. Consequently, such devices are expensive both in manufacture and to maintain.

One way in which to provide a selective display of multiple playing indicia is to reproduce actual images thereof on a web or strip of material and incrementally transport it between a pair of reels or spools such that only one image is positional behind a viewing window at any particular time. However, to do so has heretofore required the use of complicated multiple motor driving and braking systems in order to rapidly roll the web from one reel to the other and at the same time control the drag on the web so as to prevent slack therein due to speed differentials between the two reels.

Another problem associated with the prior art apparatus relates to the difficulty associated with the mechanical positioning and electrical interconnection of the various functional components within the external enclosure. Typically, electrical wires and mechanical components are so closely positioned within the enclosure that servicing is quite complex and contributes substantially to the maintenance expense associated with the apparatus.

SUMMARY OF THE PRESENT INVENTION

It is therefore a principal object of the present invention to provide a simplified electro-mechanical gaming apparatus utilizing a minimum of functional components arranged in various modules which are both supported and electrically interconnected by means of a printed circuit board.

Another object of the present invention is to provide a reel-to-reel web driving and display apparatus which can be rapidly and accurately driven to precisely position the web relative to a viewing aperture.

Another object of the present invention is to provide a reel-to-reel web driving and display apparatus having a single reversible drive motor for simultaneously driving both take-up and supply reels, and means for maintaining the tension in the driven web constant.

Briefly, a preferred embodiment of the present invention includes an outer housing having a front panel hingedly attached to form a housing closure. The outer surface of the front panel provides a playing surface including windows thereof which various indicators may be viewed and switches enabling player interaction. The rear side of the front panel is in the form of a printed circuit board including a network of printed circuit conductors disposed thereon. Also affixed to the rear side of the first panel and supported thereby are various switches, electronic components, indicators, lights and facsimile display modules, all of which are electrically interconnected by means of the printed circuit conductors. The facsimile display modules each include a pair of web carrying reels which are reversibly driven by a single reversible motor and means for maintaining constant tension in the web as it is wound and unwound upon the respective reels. Sensing means is also provided for accurately detecting and facilitating the positioning of web carried indicia relative to a viewing window.

Among the advantages of the present invention are that it provides apparatus which is relatively simple to manufacture and service due to its utilization of modular components and printed circuit board technology.

Another advantage of the present invention is that it provides a novel mechanism for quickly and accurately driving and displaying web carried indicia.

These and other objects and advantages of the present invention will no doubt become apparent to those of ordinary skill in the art after having read the following detailed description of the preferred embodiment.

IN THE DRAWING

DETAILED DESCRIPTION OF THE PREFERRED EMBODIMENT

Figure 1:
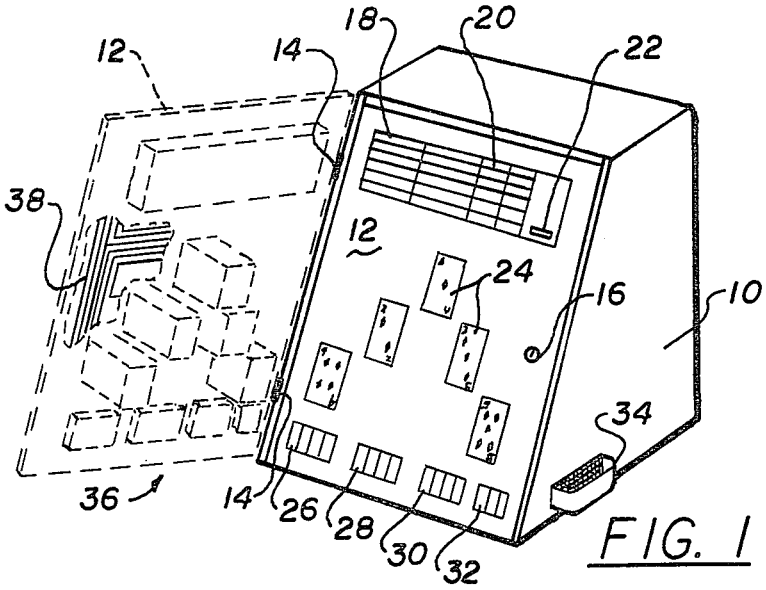
FIG. 1 is a perspective view illustrating the external appearance of a gaming apparatus in accordance with the present invention.

Referring now to FIG. 1 of the drawing, there is shown a gaming apparatus of a type particularly suited for five card poker and including a cabinet 10 having a windowed front closure panel 12 which is hingedly affixed to cabinet 10 by means of hinges 14 and is locked in position by means of a suitable keyed lock such as that illustrated at 16. At the top of the closure panel 12 is an array of play indicator windows 18 of the type which might display indicia indicating selected game, betting odds, etc., a plurality of push buttons 20 for enabling selection of play mode, bet, draw and other operational inputs by the player, and a coin receiving slot 22.

In the central portion of panel 12, five card display windows 24 are provided through which playing cards selected by the card display modules are displayed. At the bottom of panel 12 are four sets of indicators 26, 28, 30 and 32 which might, for example, respectively indicate amount won, amount paid, amount credited and amount bet. At the side of cabinet 10 is a winnings return chute 34.

As will be explained in more detail below, panel 12 serves the dual purpose of providing a mounting surface to which various switching display and indicator modules are mounted as shown at 36 by the dashed lines, and the back surface thereof is provided with a plurality of printed circuit connectors shown in part at 38 which electrically interconnect the various functional modules. In order to provide proper insulation between the various conductors 38 at least a portion of the panel forming the rear surface supporting the conductors should be fabricated of an insulative material. In the preferred embodiment, the entire panel 12 is formed in the same manner as an ordinary printed circuit board.

Figure 2:
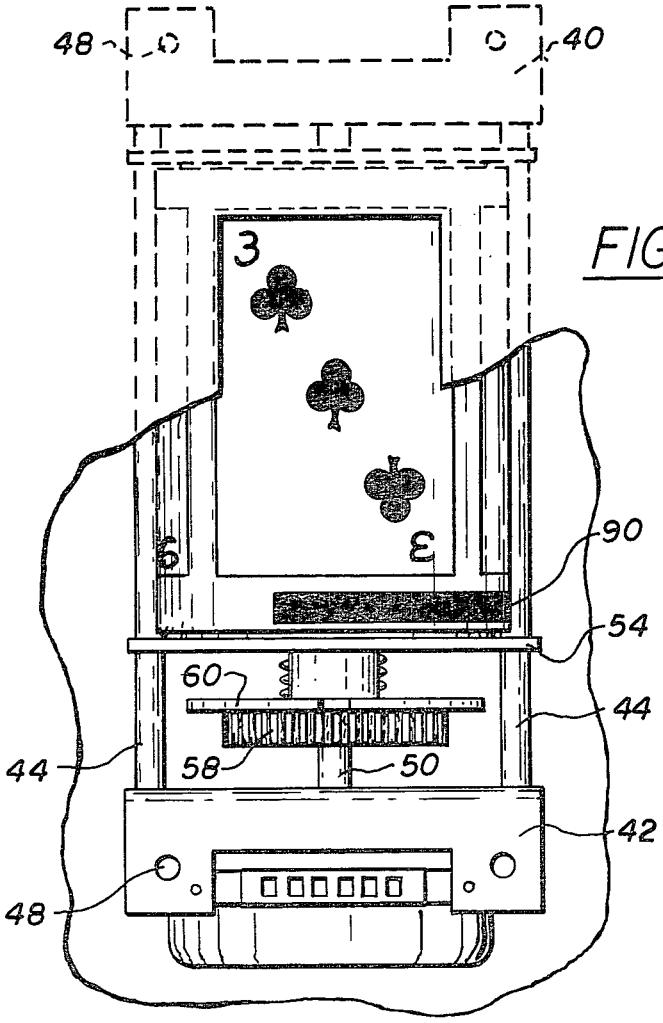
FIG. 2 is a front view illustrating components of a web driving reel-to-reel display module in accordance with the present invention.
Figure 3:
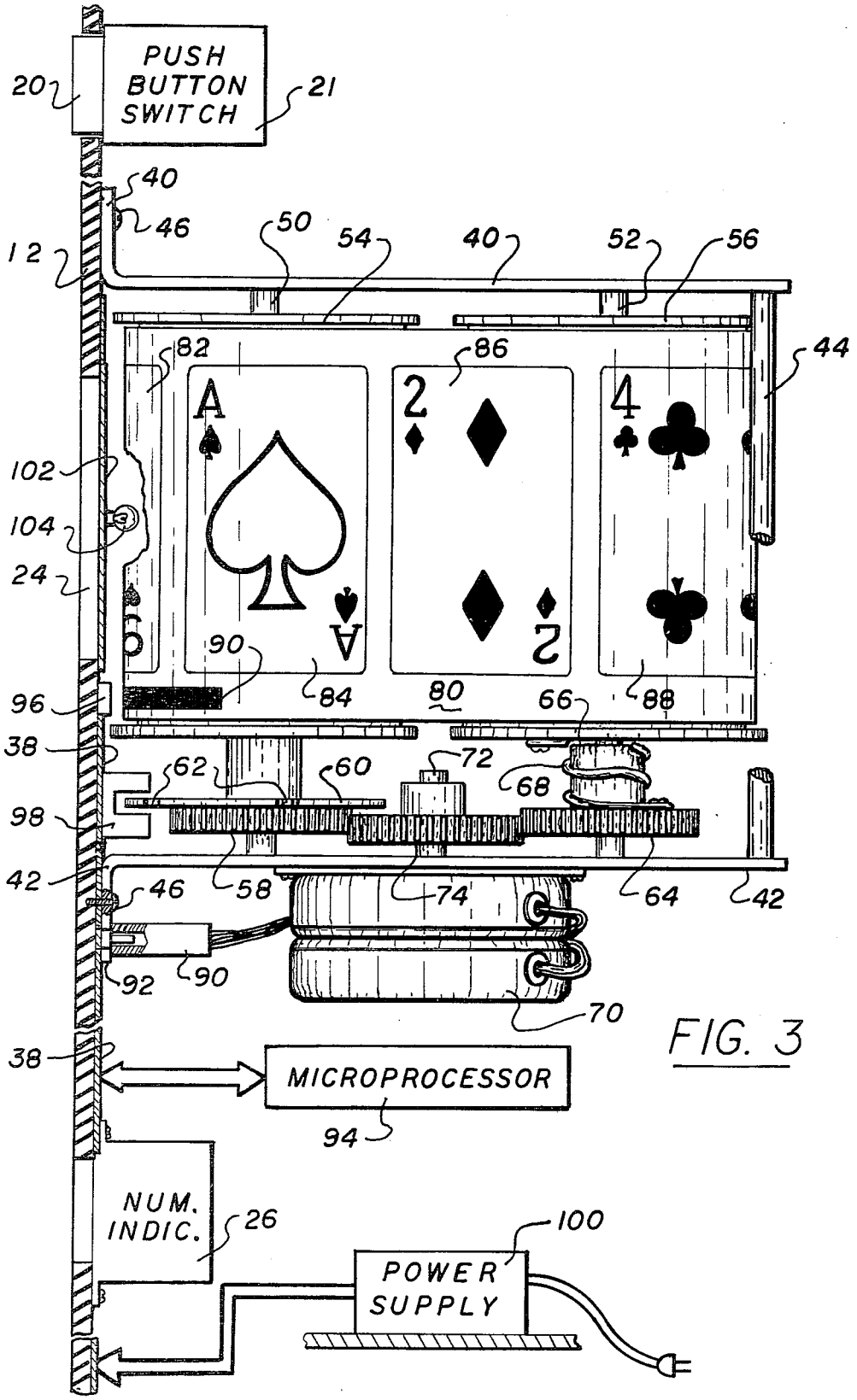
FIG. 3 is a partially broken side view showing the various components of the display module shown in FIG. 2 along with and other components of a gaming apparatus in accordance with the present invention.

Turning now to FIGS. 2 and 3 which respectively illustrate front and side views of a card display module in accordance with the present invention, it will be noted that the module includes upper and lower plates 40 and 42 which are connected together at the rear by a pair of posts 44. The plates 40 and 42 are respectively turned upwardly and downwardly at their forward most extremities to provide mounting flanges for facilitating attachment of the module to the rear surface of panel 12 by means of screws 46 passed through apertures 48.

Journalled to plates 40 and 42 are a pair of vertically oriented reel supporting shafts 50 and 52 which respectively carry a front reel 54 and a rear reel 56. Affixed to the bottom of reel 54 and pinned to shaft 50 is a gear wheel 58. Affixed to the top surface of gear wheel 58 is a circular shutter plate 60 having four notched openings 62 provided at 90° intervals around its perimeter. Positioned at the bottom of reel 56 and affixed to shaft 52 but not to reel 56 is a rear gear wheel 64 substantially identical to gear wheel 58. The upper end surface 66 of gear wheel 64 which provides a support surface upon which the bottom of reel 56 is supported.

Reel 56 is not pinned to shaft 52 and is free to turn thereon in frictional engagement with gear wheel end surface 66. However, reel 56 is coupled to gear wheel 64 by means of a coil spring 68 which, as will be explained below, resiliently biases reel 56 rotationally relative to gear wheel 64 and at the same time provides a drive coupling therebetween. Affixed to the bottom of plate 42 is a reversible stepping motor 70, the drive shaft 72 of which extends through an opening in plate 42 and has affixed thereto a drive gear 74. Gear 74 is at all times in engagement with both gear wheel 58 and gear wheel 64 so as to drive both gear wheels at the same rotational speed and in the same direction. As suggested above, gear wheels 58 and 64 are of the same diameter and have the same number of teeth.

Carried by reels 54 and 56, with one end being affixed to each reel, is a web 80 which in the preferred embodiment is a strip of thin plastic material having printed thereon in side by side spaced apart relationship a plurality of facsimiles of playing cards, as illustrated at 82, 84, 86 and 88. Although the strip 80 could contain any number of a card facsimiles of any combination of denominations, in the preferred embodiment, the strip of each module contains facsimiles of all 52 cards of a standard deck arranged arbitrarily but in a known sequence. In addition, several card backs may also be included at each end of the web to add an aspect of realism to game play. Also provided at the bottom of each strip is at least one end identifying stripe 90.

All of the several cards depicted on web 80 are is of identical size but are differentially spaced relative to each other such that when wrapped upon reel 54 the vertical center lines of each facsimile lies coincident with either the 0°, 90°, 180° or 270° radial of reel 54. It will be appreciated that since the outer diameter of the web wrapped reel effectively increases as more web is wrapped thereupon, the spacing between card facsimile centers must increase along the strip from one end to the other.

More specifically, the change in center-to-center distance between successive adjacent card facsimiles may be expressed as $\pi\Delta D/4$ where the change in effective diameter for each complete wrap $\Delta D$ is equal to twice the thickness of the web 80. Although the cards could be equally spaced with external sensors being used to sensor card edges or indicator marks placed on the web, it will be appreciated that by merely incrementally increasing the spacing between card facsimiles, positioning of the facsimiles relative to the display windows 24 will be greatly simplified since they will always be accurately positioned relative to particular radials of the carrying reel. Consequently, selection of drive and drive gears that are related in a one-to-one ratio will mean that angular position of the reel 54 will be directly related to the angular position of the drive motor 70. Hence, a stepping motor is ideally suited for the present application.

In order to insure that the tension in web 80 remains constant as it is wrapped on and off of reel 54, spring 68 is preloaded sufficient to allow reel 56 to rotationally advance and retard relative to gear wheel 64 by that angle required to compensate for the difference in effective diameter of the two reels as the strip is wound and unwound thereupon.

In the preferred embodiment, motor 70 is a bidirectional stepping motor which turns 71/2° per step thereby allowing it to stop reel 54 at 90° intervals. Stepping signals are input to motor 70 by means of a plug type receptical 90 carried by plate 42 and which is engaged by corresponding jack pins 92 affixed to panel 12 and electrically connected to the printed circuit conductors.

In order to insure that the operation controlling microprocessor 94 is always able to know the position of web 80, a start position sensing photodetector 96 is provided for sensing one end of a stripe 90 provided at one end of web 80, and in order to insure that reel 54 is stopped exactly at a 90° card centering position, a second photo-detector 98 is provided for sensing the indexing apertures 62 in shutter wheel 60. As do all of the functional modules including inidicators 18, switches 20 and indicators 26–32, the sensors 96 and 98 electrically communicate with microprocessor 94 via the printed circuit conductors generally shown at 38.

In the present embodiment, microprocessor 94 is programmed so that upon input of a coin in slot 22 and actuation of a particular selection push button switch 21, each of the five motors 70 will be actuated to quickly drive their corresponding web 80 onto drum 56 until indicator 96 indicates that the web is in a start position. The motors will then be reversed so as to drive each web 80 back onto reel 54, with each motor being stopped after different numbers of motor steps dictated by random number generators contained within the control electronics. Upon stopping and displaying a particular sequence or combination of cards, an instructional indicator 18 will light up telling the player that he may either keep the cards he has or draw others. The player then communicates his intentions by pushing one of the buttons 20 upon which microprocessor 94 causes the apparatus to appropriately respond. Thereafter, microprocessor will instantaneously indicate by means of the numerical indicators 26–32 the amounts of money won, will actuate a pay-out mechanism which will discharge coins into receptical 34.

Power for the various components of the device is provided by a power supply contained within cabinet 10 and supported by the device chassis as illustrated at 100. Note that power is communicated to the various functional modules and illuminators via the printed circuit conductors 38 on panel 12.

Another feature of the present invention is the provision of a thin transparent mylar strip 102 immediately behind the windows 24 and a pair of ordinary incondescent light bulbs 104 disposed one on each side of each window. The mylar surface diffuses and reflects light more or less uniformly over the curved surface at the front of the web covered reel 54 and effectively eliminates the shadowed or darkened area which would otherwise appear from top to bottom along the centerline of a displayed card due to the changing angle of incidence of light from the bulbs 104.

Although the present invention has been described above with respect to a presently prepared embodiment, it is contemplated that numerous alterations and modifications will become apparent to those skilled in the art. It is therefore intended that the appended claims be interpreted as covering all such alterations and modifications as fall within the true spirit and scope of the invention.

What is claimed is:

1. Electronic gaming apparatus comprising:

an external housing forming a chamber having an opening on the front side thereof;

a closure panel pivotally affixed to said external housing and moveable between an open position and a closed position closing said opening, said panel having a plurality of apertures in the face thereof through which indicators may be viewed and switches may extend, the rear surface of said panel being formed of an insulative material and having a plurality of printed circuit conductors arrayed thereover in a predetermined pattern;

a plurality of indicators, switches and electronic components affixed to the rear surface of said panel and electrically connected to various ones of said conductors; and at least one multi-image display module mounted to said rear surface of said panel and including rotational means carrying a plurality of gaming indicia and drive means for selectively rotating said rotational means so as to selectively position various ones of said indicia behind one of said apertures in said panel, said drive means being electrically connected to said electronic components by said conductors so as to receive driving energy therefrom, said rotational means including first and second reels and an elongated indicia carrying web having one end attached to said first reel and its other end attached to said second reel, and means coupling said drive means to both said reels so as to selectively wrap said web from one reel onto the other, said indicia being positioned upon said web at spaced intervals along the length thereof with the spaces between adjacent indicia increasing in the direction of the end attached to said second reel, the increased spacing serving to maintain the center of each indicia coincident with a particular radial of said first reel as said web is wound thereupon.

2. Electronic gaming apparatus as recited in claim 1 wherein said indicator module further includes first gear means rigidly affixed to said first reel and second gear means resiliently coupled to said second reel, and drive gear means driven by said motor and operatively engaging both said first and second gear means, the resilient connection between said second gear means and said second reel thereby allowing said second reel to rotate differentially relative to said second gear means so as to compensate for differences in reel rotation as said web is wound and unwound from one of said reels to the other.

3. Electronic gaming apparatus as recited in claims 1 or 2 and further comprising detector means carried by said panel and electrically connected to said conductors, said detector means being operative to detect particular rotational positions of said first reel.

4. Electronic gaming apparatus as recited in claim 3 wherein said first reel is disposed adjacent said aperture and directly between said one aperture and said second reel such that the gaming indicia viewable through said one aperture is wrapped about an arcuate portion of said first reel.

5. Electronic gaming apparatus as recited in claim 4 and further comprising illuminating means disposed on each side of said one aperture and proximate the rear surface of said panel, and transparent means covering said aperture and serving to reflect light from said illuminating means onto the indicia carrying portion of the web viewable through said one aperture.

6. Multi-image display means for selectively positioning one of several individual images forming communicative indicia behind a viewing aperture comprising:

first reel means;

second reel means;

elongated web means carrying a series of discrete indicia disposed along its length and having one end affixed to said first reel means and its other end affixed to said second reel means; said web means being wound about said first and second reel means so as to be transportable from one to the other, each said indicia being positioned upon said web means at spaced intervals along the length thereof with the spaces between adjacent indicia increasing in the direction of the end attached to said second reel means, the increased spacing serving to maintain the center of each indicia coincident with a particular radial of said first reel means as said web means is wound thereupon;

first gear means rigidly affixed to said first reel means;

second gear means resiliently coupled to said second reel means;

drive gear means driveably coupled to both said first and second gear means; and motor means coupled to said drive means and operative to simultaneously drive said first and second reel means so that said web is unwound from one reel and wound onto the other, the resilient coupling between said second gear means and said second reel means being operative to accommodate any reel rotation differential required to maintain taughtness in said web means.

7. Multi-image display means as recited in claim 6 wherein said first reel means is disposed adjacent said aperture and directly between said aperture and said second reel means such that the indicia viewable through said aperture is wrapped about an arcuate portion of said first reel means.

* * * * *